United States Patent [19]

Waatanabe

[11] Patent Number: 4,710,016

[45] Date of Patent: Dec. 1, 1987

[54] DEVELOPING APPARATUS

[75] Inventor: Junji Waatanabe, Yokohama, Japan

[73] Assignee: Kabushiki Kaisha Toshiba, Kawasaki, Japan

[21] Appl. No.: 835,249

[22] Filed: Mar. 3, 1986

[30] Foreign Application Priority Data

Mar. 26, 1985 [JP] Japan ..... 60-61477
Jul. 15, 1985 [JP] Japan ..... 60-155508

[51] Int. Cl.[4] ..... G03G 15/08; G03G 15/01

[52] U.S. Cl. ..... 355/4; 355/3 DD; 355/14 D

[58] Field of Search ..... 355/4, 14 D, 3 DD; 118/657, 653; 430/120, 122

[56] References Cited

U.S. PATENT DOCUMENTS 4,053,216 10/1977 Mailloux ..... 355/4
4,339,196 7/1982 Beck et al. ..... 355/3 DD
4,466,379 8/1984 Nishimura ..... 118/658
4,591,261 5/1986 Saruwatari et al. ..... 355/4
4,615,612 10/1986 Ohno et al. ..... 355/14 D
4,619,518 10/1986 Kameyama et al. ..... 355/4

*Primary Examiner*—A. C. Prescott
*Attorney, Agent, or Firm*—Oblon, Fisher, Spivak, McClelland & Maier

[57] ABSTRACT

A first developing unit is arranged close to an image carrier for developing a latent image formed on the surface of the image carrier with a first developer, and a second developing unit is arranged close to the image carrier for developing a latent image formed on the surface of the image carrier with a second developer. An actuating mechanism is connected to first and second moving mechanism for selectively actuating the first and second moving mechanisms so that the first or second developing unit is operatively associated with the image carrier without the rotation of the magnet rollers.

10 Claims, 20 Drawing Figures

DEVELOPING APPARATUS

BACKGROUND OF THE INVENTION

1. Field of the Invention

The present invention relates to a developing apparatus which is applied to an image forming device such as a two-color copying machine.

2. Discussion of Background

Development of color versions has recently been promoted in the field of copying machines. For example, two-color copying machines have been developed for practical use which can produce color images in some other color than black. The developing apparatus applied to the color copying machine of this type includes two developing units facing a photosensitive drum (an image carrier). For example, a first developing unit can contain a red toner, and a second developing unit can contain a black toner. U.S. Pat. No. 4,466,379 (Nishimura) shows developing apparatus of this type. In this developing apparatus, the first developing unit comprises a first magnet roller arranged close to the photosensitive drum and a first sleeve rotatively arranged on the outer peripheral surface of the first magnet roller. The first magnet roller includes a first main pole and a pair of first convey poles sandwiching the first main pole. The first magnet roller is coupled to a first drive mechanism which rotates it through about 180° in the clockwise and counterclockwise directions. The first sleeve is made of a nonmagnetic material and spaced from the photosensitive drum by a predetermined distance. The first sleeve is coupled to a first rotary mechansim. The second developing unit comprises a second magnet roller arranged close to the photosensitive drum and a second sleeve rotatively arranged on the outer peripheral surface of the second magnet roller. The second magnet roller includes a second main pole and a pair of second convey poles sandwiching the second main pole. The second magnet roller is coupled to a second drive mechanism which rotates it through about 180° in the clockwise and counterclockwise directions. The second sleeve is made of a nonmagnetic material and spaced from the photosensitive drum by a predetermined distance. The second sleeve is coupled to a second rotary mechanism. A red developer is contained in the first developing unit, and a black developer is contained in the second developing unit.

If the red developing operation for the electrostatic latent image formed on the photosensitive drum is selected, the first drive mechanism causes the first main pole of the first magnet roller to face the surface of the drum. The first sleeve is rotated by the first rotary mechanism, and the magnetic brush of the red developer is formed on the first sleeve. The magnetic brush of the red developer is brought into contact with the photosensitive drum. As a result, the electrostatic latent image on the drum is developed with the red developer. Prior to developing in red, the second main pole of the second developing unit in rotated to the opposite side away from the drum by the counterclockwise rotation of the second drive mechanism, and the second sleeve is at rest. Therefore, as the magnetic brush of the black developer is not formed, black developer is not brought into contact with the drum. Thus, only the red developing operation is performed.

If the black developing operation for the electrostatic latent image formed on the photosensitive drum is selected, the first main pole of the first magnet roller is rotated to the opposite side away from the drum by the counterclockwise rotation of the first drive mechanism. At the same time. the second drive mechanism causes the second main pole of the second magnet roller to face the surface of the drum. The second sleeve is rotated by the second rotary mechanism, and the magnetic brush of the black developer is formed on the second sleeve. The magnetic brush of the black developer is brought into contact with the photosensitive drum. As a result, the electrostatic latent image on the drum is developed with the black developer. Prior to developing in black, the first main pole of the first developing unit is rotated to the oppsoite side away from the drum by the counterclockwise rotation of the first drive mechanism, and the first sleeve is at rest. Therefore, as the magnetic brush of the red developer is not formed, red developer is not brought into contact with the drum. Thus, only the black developing operation is performed.

However, in a conventional developing apparatus as described above, prior to developing in a first color, the second main pole of the second color developing unit must be rotated to the opposite side away from the photosensitive drum by the rotation of the second drive mechanism, and the second sleeve is at rest. Thus, there is no formation of the magnet brush of the second color developer. Therefore, the first and second developing unit require drive mechanisms such as reversible motors to rotate the first and second magnet rollers in the clockwise or counterclockwise direction. As a result, the parts of the developing apparatus increase in number, and the apparatus is expensive. Further, the developing apparatus requires control circuits to control the rotation in the clockwise or counterclockwise direction of these drive mechanisms. Therefore, the construction of the whole of the copying machine is complicated.

OBJECT OF THE INVENTION

Accordingly, a principal object of the present invention is to provide a developing apparatus which is capable of surely preventing that the developer of a nonused developing unit from inadvertently adhering to a photosensitive drum (an image carrier) without the rotation of magnet rollers.

SUMMARY OF THE INVENTION

According to one aspect of the present invention, there is provided a developing apparatus which comprises a first developing unit arranged close to an image carrier for developing a latent image formed on the surface of the image carrier with a first developer, a second developing unit arranged close to the image carrier for developing a latent image formed on the surface of the image carrier with a second developer, a first moving mechanism for moving the first developing unit between a first position where the first developing unit comes near the image carrier and a second position where the first developing unit is separated from the image carrier, a second moving mechanism for moving the second developing unit between a first position where the second developing unit comes near the image carrier and a second position where the second developing unit is separated from the image carrier, and an actuating mechanism connected to the first and second moving mechanism for selectively actuating the first and second moving mechanisms so that the first or second developing unit comes near the image carrier while the second or first developing unit is separated from the image carrier.

BRIEF DESCRIPTION OF THE DRAWINGS

FIGS. 2 and 3 are front views showing the moving mechanisms of each developing unit.

FIG. 4 is a side veiw showing a guide mechanism for the developing apparatus.

FIGS. 5 and 6 are front views showing a mechanism to rotate the developing rollers of each developing unit.

FIGS. 7 and 8 are front views showing the approach or separation state of the developing rollers of each developing unit for the photosensitive drum.

FIG. 9 is a transverse sectional view of developing rollers.

FIG. 10 is a longitudinal sectional view of the developing rollers shown in FIG. 9.

FIG. 11 is a front view showing a shaft portion of the magnet roller.

FIG. 12 is a perspective view of the shaft portion of the magnet roller shown in FIG. 11.

FIG. 13 is a disassembled perspective view showing the moving mechanism and drive mechanism of each developing unit.

FIG. 14 is a sectional view showing the support portion of the link.

FIG. 15 is a front view of the support portion of the link shown in FIG. 14.

FIG. 16 is a front view showing the cam mechanism for selectively driving the moving mechanism.

FIG. 17 is a sectional view of the cam mechanism shown in FIG. 16.

FIGS. 18–20 are front views of the approach or separation state of the developing rollers of each developing unit for the photosensitive drum.

DETAILED DESCRIPTION OF THE PREFERRED EMBODIMENTS

One embodiment of a developing apparatus according to the present invention applied to a two-color copying machine will now be described in detail with reference to FIGS. 1–8.

Figure 1:
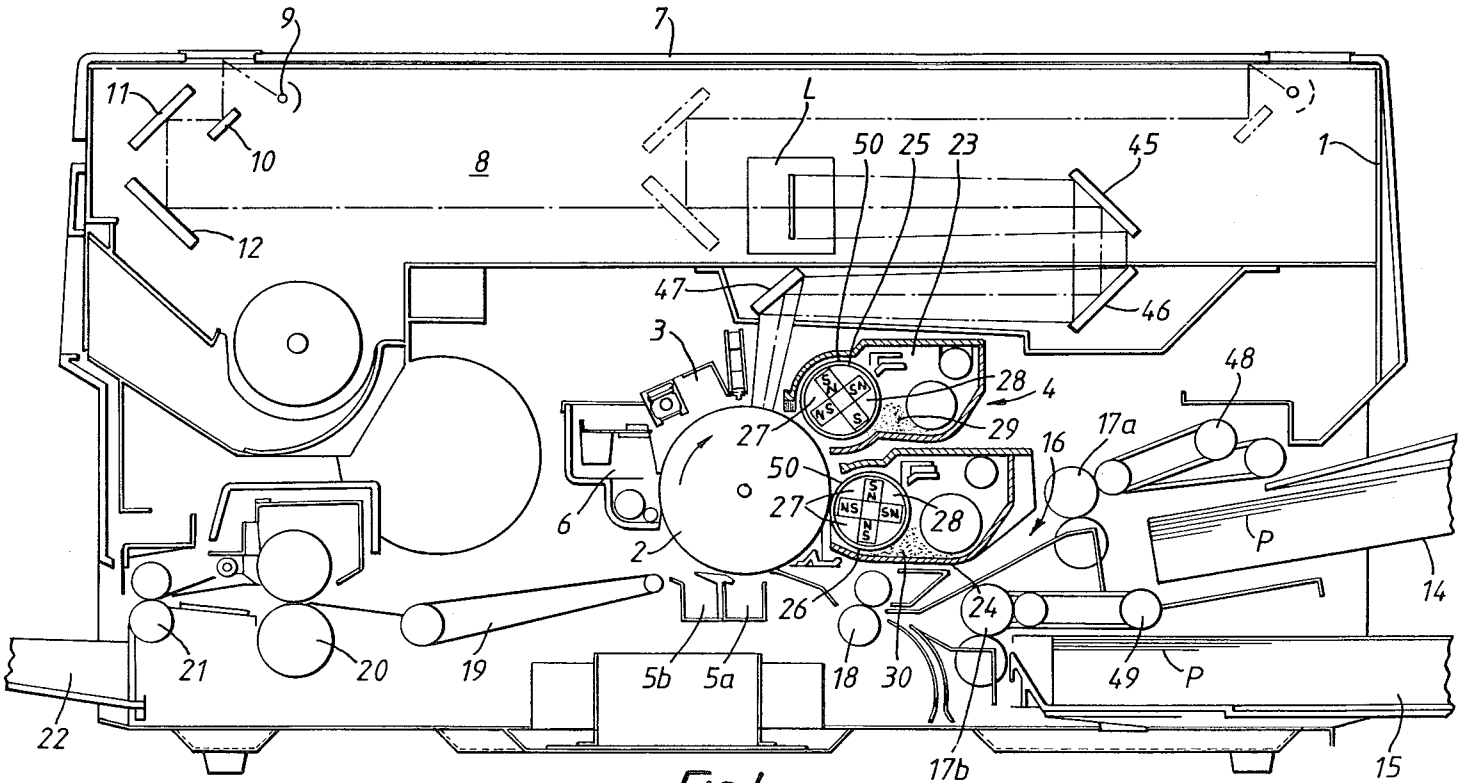
FIG. 1 is a schematic front view showing the arrangement of a two-color copying machine in which the developing apparatus of the present invention is employed.

FIG. 1 shows a two-color copying machine in which the developing apparatus according to the present invention is employed. A document table 7 consisting of transparent glass which supports the document to be copied is provided at the top of a main body 1 of the copying machine. An optical system 8 that can move reciprocatingly is provided below the document table 7. The optical system 8 comprises an exposure lamp 9 which irradiates the document placed on the document table 7 and moving mirrors 10, 11, and 12 which direct the light reflected from the document. When the optical system 8 moves from left to right in FIG. 1, it scans the document placed on the document table 7 by exposing it to light. The moving mirrors 11 and 12 move at half the speed of the mirror 10 so as to maintain an optical path of constant length. The light reflected from the document as it is scanned by the optical system 8 (i.e., the light from the exposure lamp 9 reflected back from the document), after being reflected by the moving mirrors 10, 11, and 12, passes through a lens L. After being reflected by fixed mirrors 45, 46, and 47, the reflected light is directed to a photosensitive drum 2 (i.e., an image carrier). An image of the document is then formed on the surface of the photosensitive drum 2.

The photosensitive drum 2 rotates in the direction indicated by the arrow in FIG. 1. First, the surface of the photosensitive drum 2 is electrically charged by a main charger 3. Next, an electrostatic latent image of the document is formed on the photosensitive drum 2 by slit exposure. This electrostatic latent image is rendered visible when the toner image is formed by the deposition of developer (i.e., toner deposited on the photosensitive drum 2 by a developing apparatus 4). Paper P is extracted one sheet at a time by a feed roller 48 or a feed roller 40 from an upper cassette 14 or a lower cassette 15, whichever has been selected. The extracted paper P is guided to a pair of aligning rollers 18 by a chute 16 and a transport roller **17*a* or a transport roller 17*b* and is fed by the pair of aligning rollers 18 to the image transfer station. Cassettes 14 and 15 are so arranged that they can be readily inserted into or withdrawn from the main body 1. One of the cassettes 14 and 15** is selected by means of an operation panel (not shown in the drawings).

The paper P which has been fed to the image transfer station adheres closely to the surface of the photosensitive drum 2. By this means the toner image on the photosensitive drum 2 is transferred by the action of a transfer charger **5*a* to the paper P. The paper P on to which the toner image has been transferred is separated from the photosensitive drum 2 by the action of a separation charger 5*b* and carried on a conveyer belt 19. It is then fed to a pair of fixing rollers 20 provided at the end of the conveyer belt 19. By means of the passage of the paper P through the fixing rollers 20, the toner image on the paper P is fixed. After fixing, the paper P is discharged by a pair of exit rollers 21 on to a receiving tray 22 provided outside the main body 1. After the transfer of the toner image, any residual toner is removed from the photosensitive drum 2 by a cleaner 6**.

Figure 4:
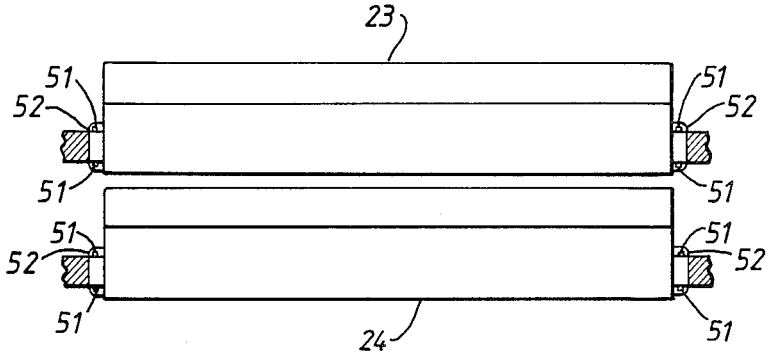
FIGS. 2–8 show a first embodiment of the developing apparatus of the present invention.

An explanation will now be given of a first embodiment of the development apparatus 4 according to the present invention. As shown in FIG. 1, the developing apparatus 4 comprises a first developing unit 23 located in the upper position and a second developing unit 24 located in the lower position. A developing roller 25 is provided in the first developing unit 23, and a developing roller 26 is provided in the second developing unit 24. The developing rollers 25 and 26 each comprise a magnet roller 28 having plural magnetic poles 27 and a sleeve 50 containing the magnet roller 28 therein. A toner 29 (such as a red color developer) is contained in the first developing unit 23, and a toner 30 (such as a black color developer) is contained in the second developing unit 24. As shown in FIG. 4, the first and second developing units 23 and 24 are respectively supported on guide rails 52 through ball bearings 51. Accordingly, the first and second developing units 23 and 24 can be moved backward and forward along the guide rails 52. That is, the first and second developing units 23 and 24 can be moved in the direction toward the photosensitive drum 2 or in the direction away from the photosensitive drum 2.

Figure 2:
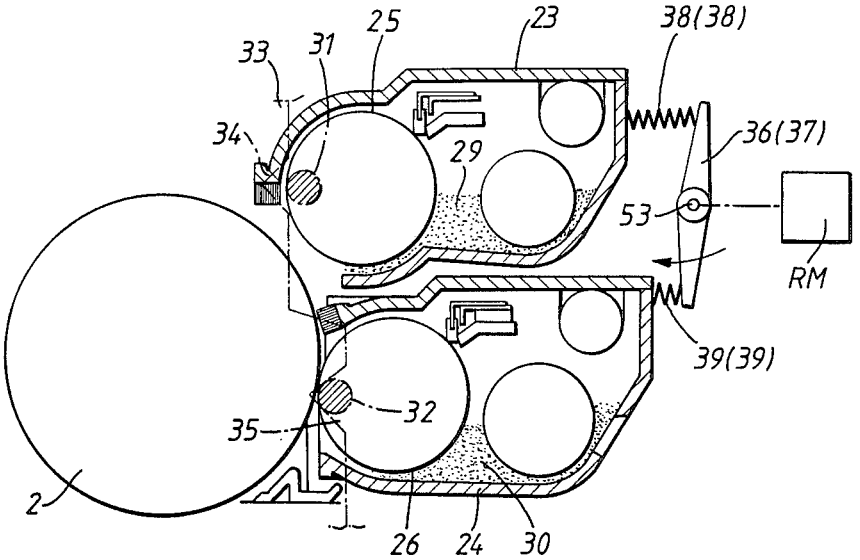
Figure 3:
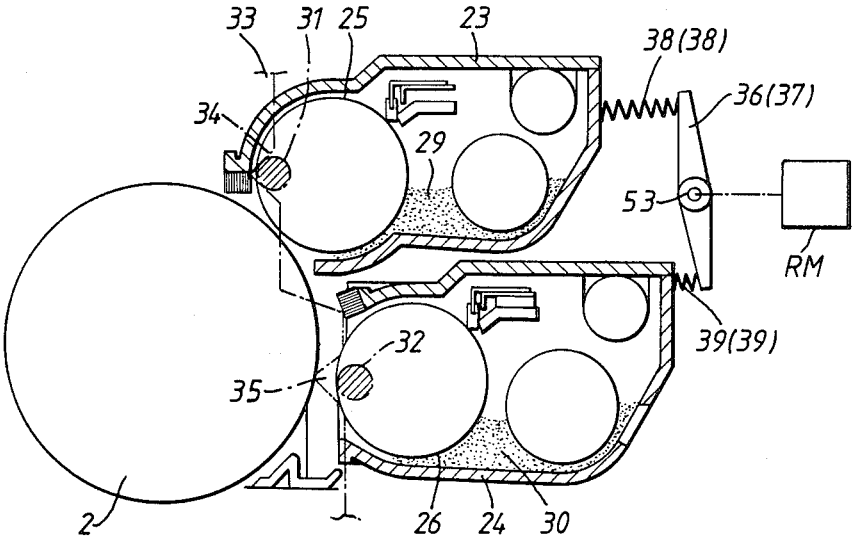

As is shown in FIGS. 2 and 3, at the forward ends of the first and second developing units 23 and 24, respectively, pins 31 and 32 project outwardly. The pins 31 and 32 face V-shaped recesses 34 and 35 formed on a frame 33 that is part of the main body 1. One end of each of a pair of coil springs 38 is mounted to the rear surface of the first developing unit 23. In like manner, one end of each of a pair of coil springs 39 is mounted to the rear surface of the second developing unit 24. The other end of each of the coil springs 38 is mounted to one end of each of a pair of arms 36 and 37 provided behind the first and second developing units 23 and 24. In like manner, the other end of each of the coil springs 39 is mounted to the other end of each of the arms 36 and 37. The arms 36 and 37 rotate around a shaft 53 provided at the middle portion of the arms 36 and 37. The shaft 53 is connected to a reversible motor RM. when the reversible motor RM rotates clockwise or counterclockwise, the first and second developing units 23 and 24 move in the direction toward the photosensitive drum 2 or away from the photosensitive drum 2. The motion of the shaft 53 is transmitted through the arms 36, 37 and the springs 38, 38, 39, and 39. That is, the reversible motor RM rotates the arms 36 and 37 in the clockwise or counterclockwise direction when an operator selects a red or black color selection key (not shown).

Figure 5:
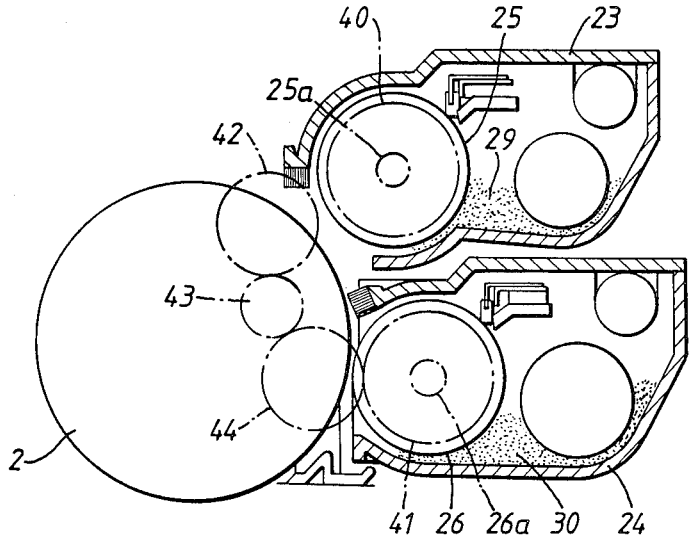
Figure 6:
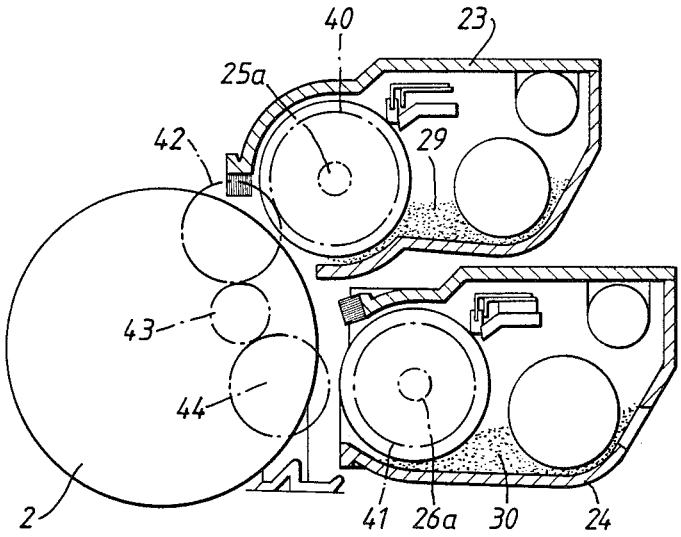

As is shown in FIGS. 5 and 6, gears 40 and 41 are respectively mounted at one end of rotary shafts 25*a* and 26*a* on which the developing rollers 25 and 26 are mounted. First, second, and third gears 42, 43, and 44 are arranged on the frame 33 of the main body 1 as a rotary means. The first, second and third gears 42, 43, and 44 are rotated by a motor which is not shown. When the first developing unit 23 moves in the direction toward the photosensitive drum 2, the gear 40 engages the first gear 42. When the second developing unit 24 moves in the direction toward the photosensitive drum 2, the gear 41 engages the third gear 44. The above-mentioned motor operates when the operator selects the red or black color selection key, thereby causing the first, second, and third gears 42, 43, and 44 to be rotated.

Figure 7:
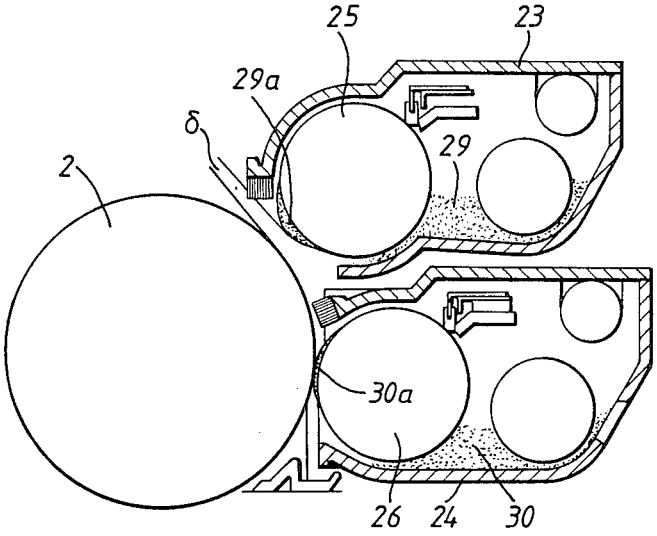

If the black color selection key is selected by the operator, the arms 36 and 37 are rotated clockwise as shown in FIG. 2. By the clockwise rotation of the arms 36 and 37, the lower ends of the arms 36 and 37 press the second developing unit 24 through the springs 39 and 39. By this pressing action, the second developing unit 24 is moved forward along the guide rails 52 and 52. When the pin 32 engages the V-shaped recess 35 in the frame 33, the forward movement of the second developing unit 24 is stopped. As a result, the gear 41 engages the second gear 44 as shown in FIG. 5. At the same time, the first developing unit 23 is drawn backward by the springs 38 and 38. The developing roller 36 is rotated through the third gear 44 and the gear 41 by rotation of a motor (not shown) which is connected to the third gear 44. A magnet brush 30*a* is formed on the surface of the developing roller 26. The magnet brush 30*a* contacts the surface of the photosensitive drum 2 as shown in FIG. 7. As a result, a black developing action is performed. Similarly, a magnet brush 29*a* is formed on the surface of the developing roller 25. When the magnet brush 30*a* is in its operative position, the magnet brush 29*a* is separated from the surface of the photosensitive drum 2 by a distance δ. Moreover, the developing roller 25 does not rotate because the gear 40 does not engage the first gear 42.

Figure 8:
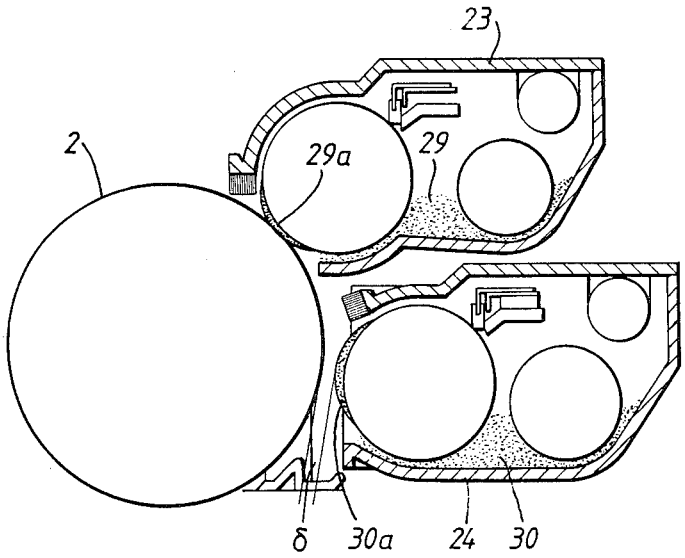

If the red color selection key is selected by the operator, the arms 36 and 37 are rotated counterclockwise as shown in FIG. 3. By the counterclockwise rotation of the arms 36 and 37, the upper ends of the arms 36 and 37 press the first developing unit 23 through the springs 38 and 38. By this pressing action, the first developing unit 23 is moved forward along the guide rails 52 and 52. When the pin 31 engages the V-shaped recess 34 in the frame 33, the forward movement of the first developing unit 23 is stopped. As a result, the gear 40 engages the first gear 42 as shown in FIG. 6. At the same time, the second developing unit 24 is drawn backward by the springs 39 and 39. The developing roller 25 is rotated by the first gear 42 and the gear 40 by rotation of a motor (not shown) which is connected to the first gear 42. The magnet brush 29*a* formed on the surface of the developing roller 25 contacts the surface of the photosensitive drum 2 as shown in FIG. 8. As a result, the red developing action is performed. At the same ime, the magnet brush 30*a* formed on the developing roller 26 separates from the surface of the photosensitive drum 2 by a distance δ. Moreover, the developing roller 26 does not rotate because the gear 41 does not engage the third gear 44.

In the first embodiment, as described above, the developing rollers 25 and 26 are rotated by the coupling of the gear 40 and the gear 41 with each other. Therefore, the motor which rotates the first, second, and third gears 42, 43, and 44 may be an ordinary motor that rotates only in one direction.

Figure 9:
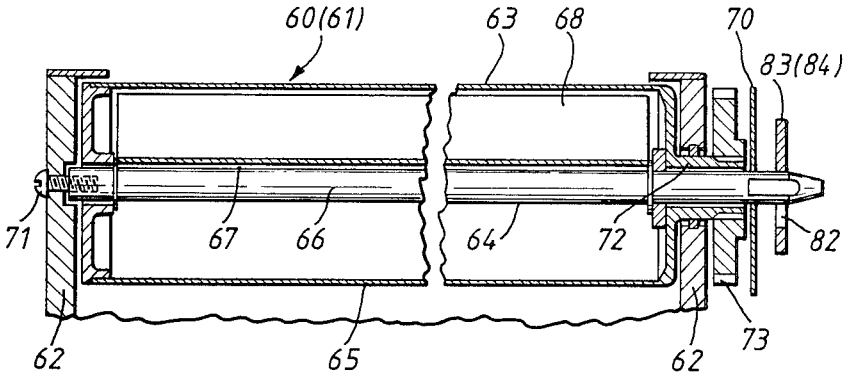
FIGS. 9–20 show a second embodiment of the developing apparatus of the present invention.
Figure 10:
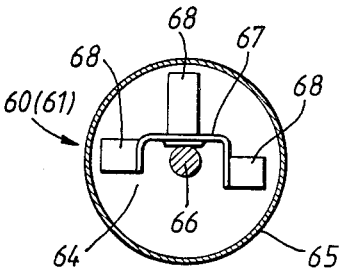
Figure 11:
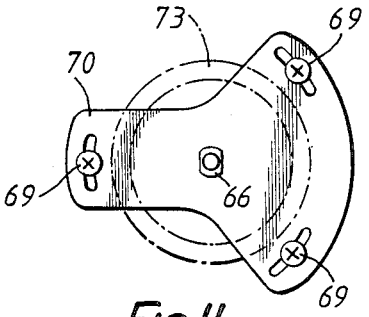
Figure 12:
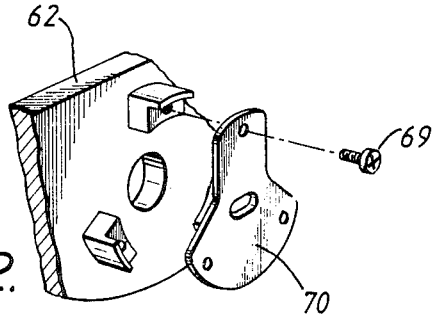

An explanation will now be given of a second embodiment of developing apparatus 4 according to the present invention. As shown in FIGS. 9 and 10, first and second developing units 60 and 61 have casings 62 in which developing rollers 63 are provided. Each developing roller 63 comprises a magnet roller 64 mounted between both side walls of the casing 62 and a sleeve 65 containing the magnet roller 64 therein. The magnet roller 64 comprises a shaft 66, a holder 67 fixed on the shaft 66, and plural permanent magnets 68 mounted on the holder 67. The permanent magnets 68 face the inside surface of the sleeve 65. The permanent magnets 68 act so as to form a magnetic brush that acts on a developer on the sleeve 65. As is shown in FIGS. 11 and 12, one end of the shaft 66 passes through a side wall of the casing 62, and this end of the shaft 66 is fixedly mounted on a support plate 70 screwed on one side of the casing 62 with screws 69. The other end of the shaft 66 is fixed to the other side of the casing 62 with a screw 71. The sleeve 65 is rotatably mounted on the casing 62 through the shaft 66. A projection tube 72 is formed integrally on one end of the sleeve 65. The projection tube 72, in which the shaft 66 is inserted, passes through a side wall of the casing 62, and a drive gear 73 is fixed to the end of the projection tube 72.

Figure 13:
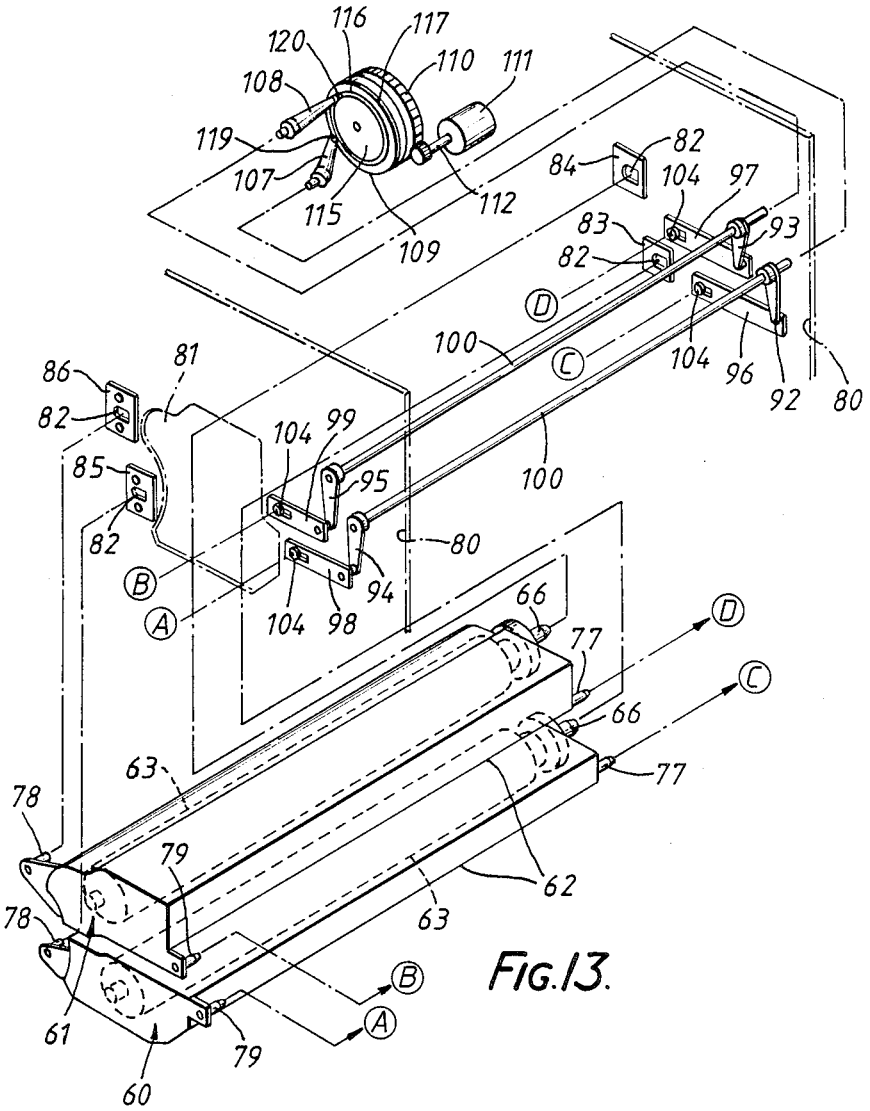
Figure 14:
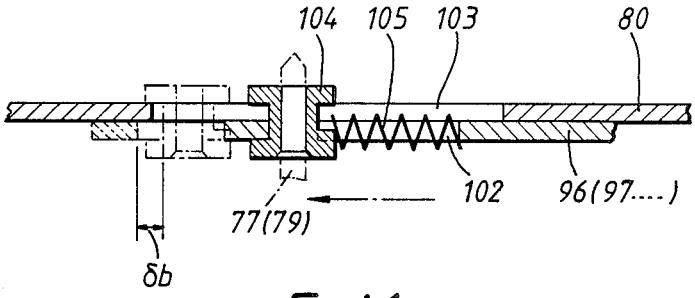
Figure 15:
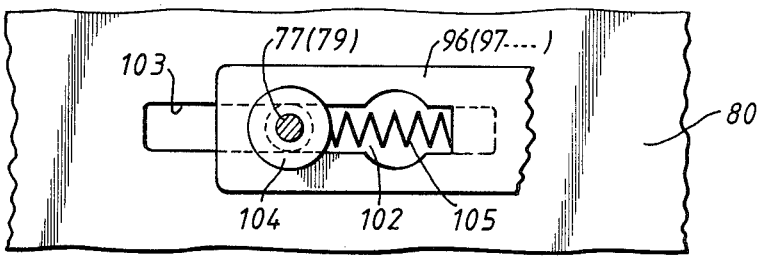

As is shown in FIG. 13, a pin 77 is mounted on one end of each casing 62, and a pair of pins 78 and 79 are mounted on the other end of each casing 62. A pair of frames 80 and 80, each of which has an aperture 81, are provided so as to face each other. Both ends of each casing 62 are loosely inserted in corresponding apertures 81 and 81 in the frames 80 and 80. Guide plates 83, 84, 85, and 86, each of which has a slit-like guide opening 82, are mounted on the frames 80 and 80. The pins 77, 77, 78, and 78 on the casings 62 and 62 are slidably inserted in the guide openings 82 in the guide plates 83, 84, 85, and 86. Levers 92, 93, 94, and 95 are provided near the frames 80 and 80, and links 96, 97, 98, and 99 are respectively rockably connected to the levers 92, 93, 94, and 95. A pair of drive shafts 100 and 100 respectively interconnect the levers 92 and 94 and the levers 93 and 95. By rotation of the drive shafts 100 and 100, the links 96, 97, 98, and 99 are reciprocatively moved through the levers 92, 93, 94, and 95. As is shown in FIGS. 14 and 15, each link 96, 97, 98, and 99 is slidably joined to the surface of the frame 80. In one end of each link 96, 97, 98, and 99, a sliding slot 102 is formed along the longitudnal direction of each link 96, 97, 98, and 99. A supporting slot 103 is formed on the frame 80 so as to face each sliding slot 102. A guide bush 104 is slidably mounted on the opening edge of each sliding slot 102 and the corresponding supporting slot 103. The guide bush 104 extends over the sliding slot 102 and the supporting slot 103. Each guide bush 104 is biased forwardly in the corresponding sliding slot 102 by a coil spring 105. The pins 77, 77, 79, and 79 mounted on the casing 62 and 62 of the first and second developing units 60 and 61 are inserted in the guide bushes 104.

Figure 16:
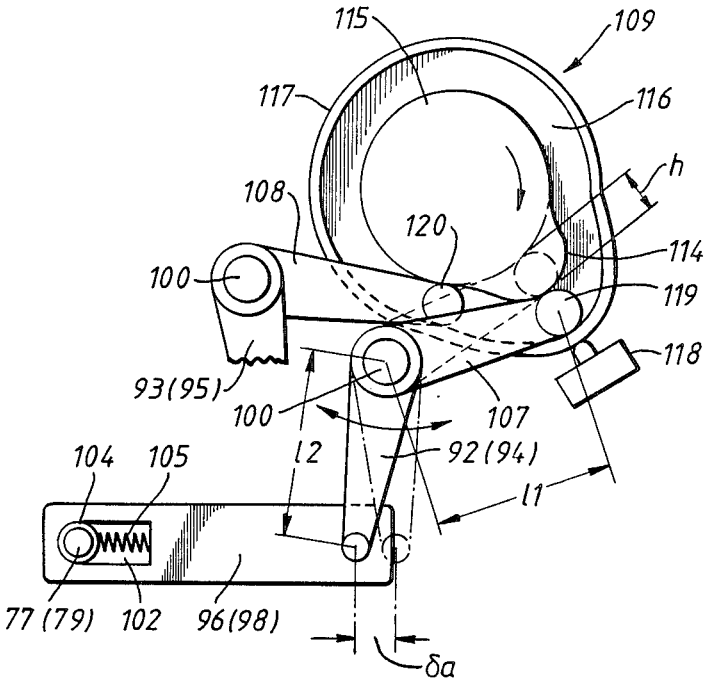
Figure 17:
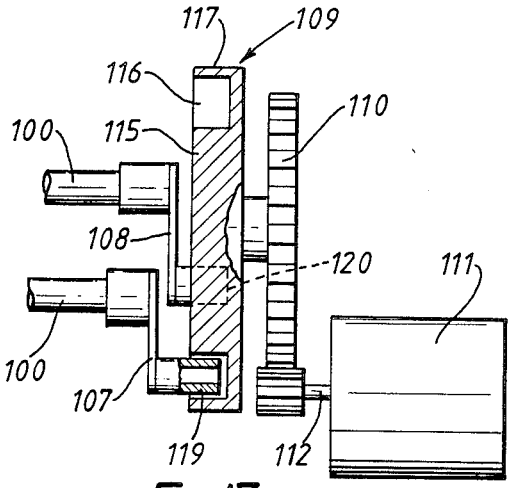

As is shown in FIGS. 13, 16, and 17, one end of each of the two follower arms 107 and 108 is connected to a corresponding end of one of the drive shafts 100 and 100. The other end of each of the follower arms 107 and 108 is connected to a rotary cam 109. A gear 110 is mounted on the rotary cam 109, and an output shaft 112 of a motor 11 is coupled to the gear 110. The rotary cam 109 comprises a cam plate 115 having a projecting portion 114 and a guide wall 117 formed along the cam surface of the cam plate 115 so as to form a circumferential groove 116 between the cam surface of the cam plate 115 and the guide wall 117. A detection switch 118 is positioned outside of the guide wall 117 of the rotary cam 109. A follower roller 119 is provided at the free end of the follower arm 107, while a follower roller 120 is provided at the free end of the follower arm 108. The follower rollers 119 and 120 are operatively coupled with the circumferential groove 116 so as to follow the rotation of the rotary cam 109, and the follower roller 119 and the follower roller 120 are separated from each other by a given distance.

Figure 18:
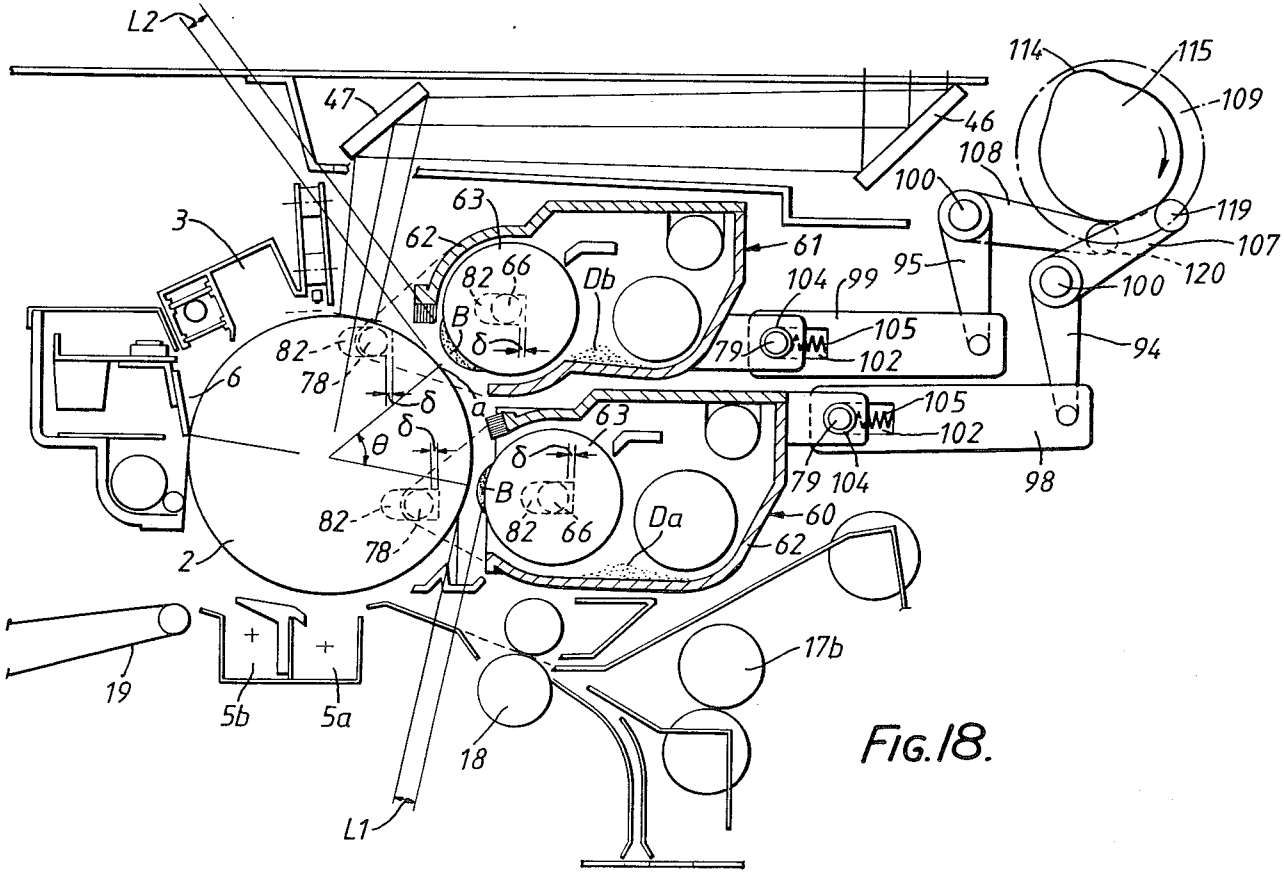

On standby of developing operation, as shown in FIG. 18, the first and second developing units 60 and 61 are separated. Namely, the developing rollers 63 and 63 of the first and second developing units 60 and 61 respectively face the photosensitive drum 2 and are spaced therefrom by large gaps L1 and L2. At this time, a slight clearance δ is formed between the pin 78 of the first developing unit 60 and the rear end of the guide opening 82 in the guide plate 85, between the pin 78 of the second developing unit 61 and the rear end of the guide opening 82 in the guide plate 86, between the shaft 66 and the rear end of the guide opening 82 in the guide plate 83, and between the shaft 66 and the rear end of the guide opening 82 in the guide plate 84. The guide bushes 104 are caused by the urging force of the coil springs 105 to contact the front ends of the sliding slots 102. Further, the projecting portion 114 of the rotary cam 109 is spaced from the follower rollers 119 and 120.

Figure 19:
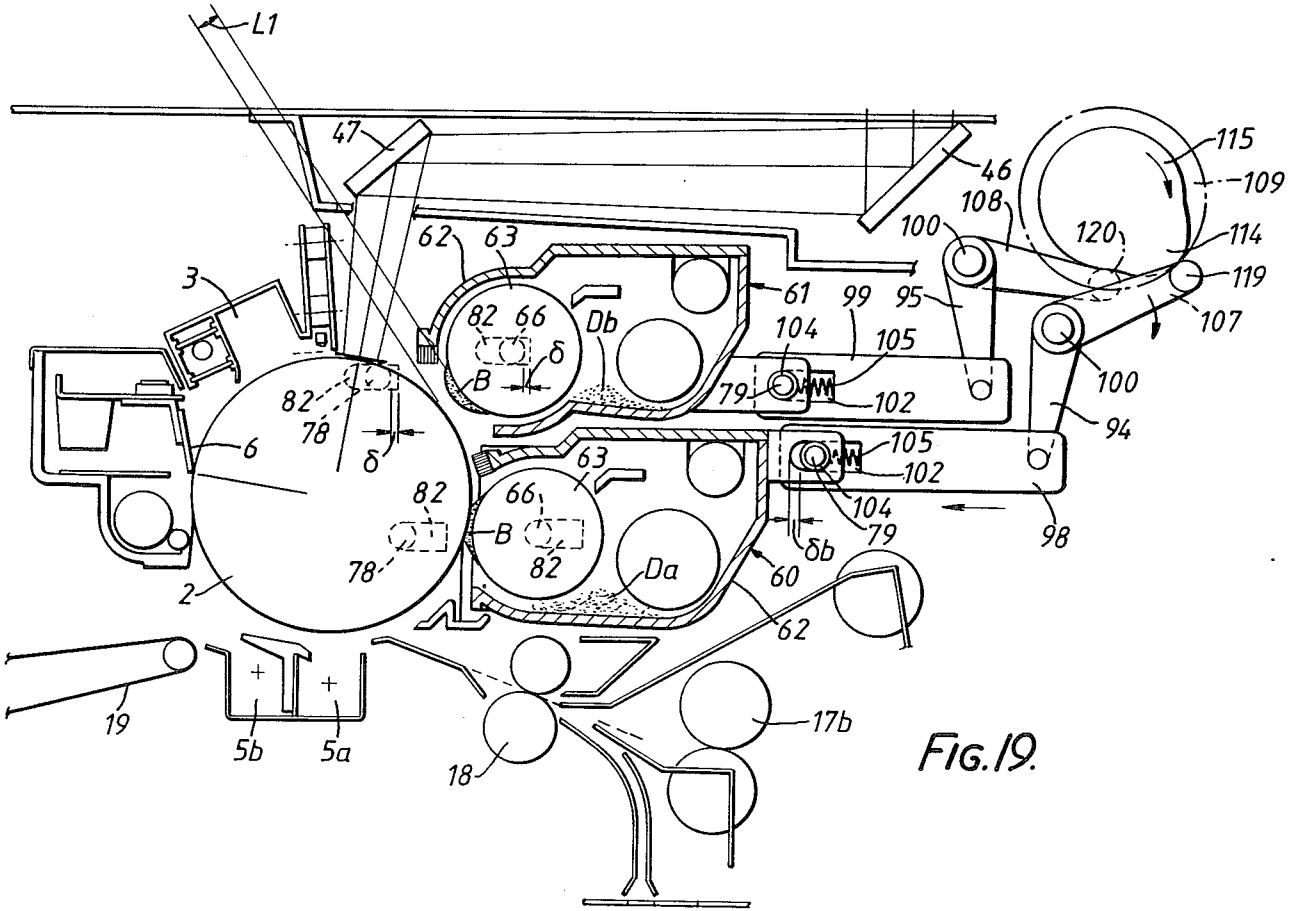

In this state, if an operator selects the action of the first developing unit 60, the motor 111 drives the rotary cam 109. By rotation of the rotary cam 109, as is shown in FIG. 19, the projecting portion 114 pushes down the follower roller 119, and the rotary cam 109 is stopped in the position where the follower roller 119 is pushed down. By the action of pushing down of the follower roller 119, the follower arm 107 rotates in the clockwise direction, thereby rotating the corresponding drive shaft 100. As a result, the links 96 and 98 are moved toward the photosensitive drum 2 by the levers 92 and 94 connected to the corresponding drive shaft 100. As shown in FIG. 16, if the projection height of the projecting portion 114 is represented as h, the length of the follower arm 107 is represented as l1, and the length of the levers 92 and 94 are represented as l2, the moving stroke distance δa of the links 96 and 98 is as follows.

$$\delta a \simeq (l2 \times l1) \times h$$

By moving the link 96 and 98, the first developing unit 60 moves to the position where the first developing unit 60 is close to the photosensitive drum 2, the shaft 66 and the pin 78 contact the front ends of the corresponding guide opneings 82, and the developing roller 63 approaches the surface of the photosensitive drum 2. By this action, in the state in which the first developing unit 60 stops, the links 96 and 98 press the coil springs 105 and 105 against the guide bushes 104 and 104. The links 96 and 98 stop moving when the top edge of the projecting portion 114 of the cam plate 115 contacts the follower roller 119 mounted on the follower arm 107 and the rotation of the rotary cam 109 stops. As a result, a small gap δb (shown in FIG. 19) is formed between the front ends of the sliding slots 102 in the links 96, 98 and the corresponding guide bushes 104. Accordingly, the moving stroke distance δa of the links 96 and 98 and moving stroke distance δc of the first developing unit 60 have the relation δa>δc. Because of this relation, the coil springs 105 and 105 are compressed. Therefore, the shaft 66 and the pin 78 of the first developing unit 60 are securely biased against the front ends of the corresponding guide openings 82 and 82 by the elastic force of the coil springs 105 and 105. As a result, positioning of the first developing unit 60 is accurately performed, and the developing roller 63 of the first developing unit 60 closely faces the surface of the photosensitive drum 2 through a given gap.

In the above state, a magnet brush B is formed on the surface of the sleeve 65 of the first developing unit 60 with toner Da by the action of the magnet roller 64. The magnet brush B contacts the surface of the photosensitive drum 2, and an electrostatic latent image formed on the photosensitive drum 2 is developed. At the same time, since the developing roller 63 of the second developing unit 61 is separated from the photosensitive drum 2, developer Db on the developing roller 63 of the second developing unit 61 does not adhere on the photosensitive drum 2. Therefore, only the first developing unit 60 performs the developing operation.

Figure 20:
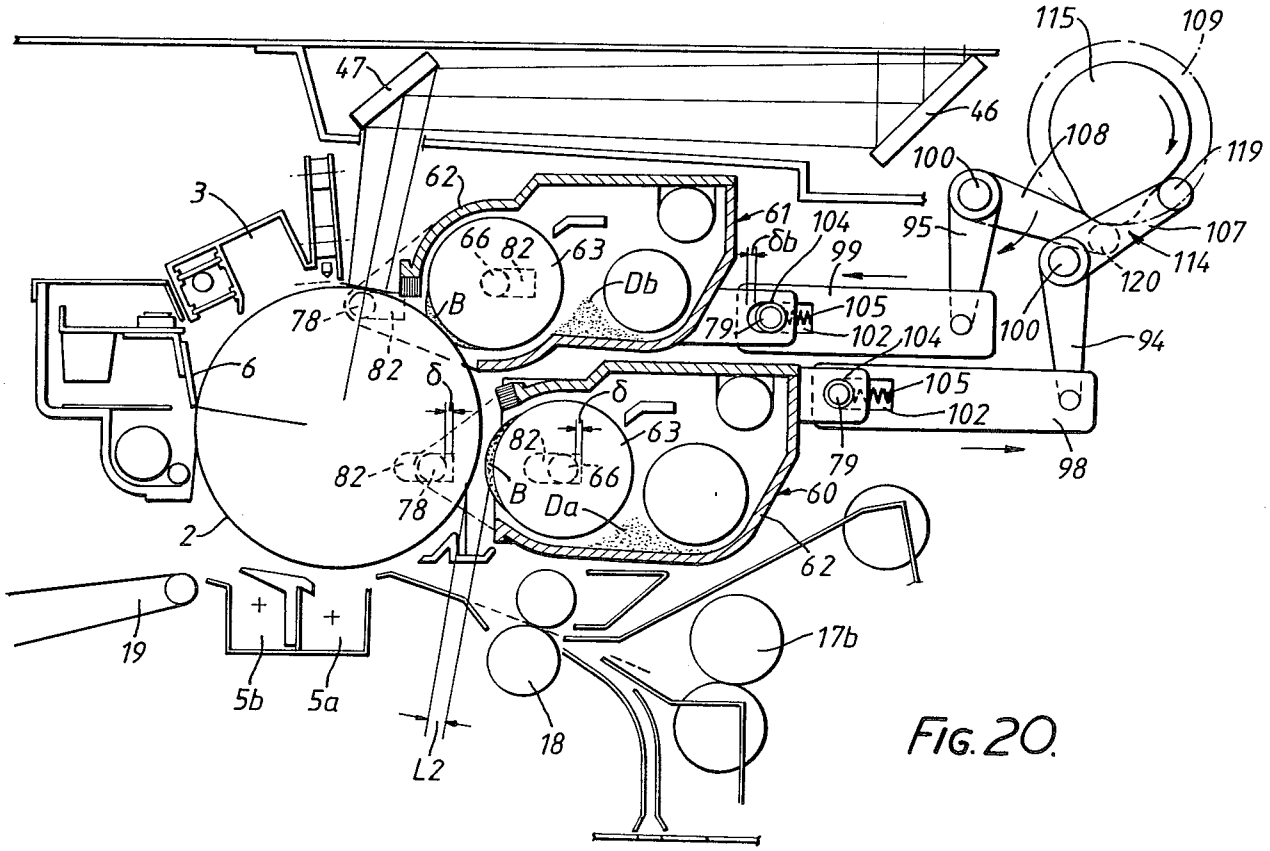

In this state, if an operator selects the action of the second developing unit 61, the motor 111 drives the rotaray cam 109. By rotation of the rotary cam 109, as shown in FIG. 20, the projecting portion 114 separates from the follower roller 119. Then, the projecting portion 114 pushes down the follower roller 120, and the rotary cam 109 is stopped in the position where the follower roller 120 is pushed down. By separation of the follower roller 119 from the projecting portion 114 of the rotary cam 109, the follower roller 119 is forcibly moved by the circumferential groove 116, and the follower arm 107 is rotated in the counterclockwise direction.

By rotation of the follower arm 107, the first developing unit 60 is moved away from the photosensitive drum 2. The follower arm 108 is rotated in the clockwise direction when the projecting portion 114 of the rotary cam 109 pushes the follower roller 120. By rotation of the follower arm 108, this rotation force is transmitted to the links 97 and 99 through the corresponding drive shaft 100 and the levers 93 and 95. Accordingly, the links 97 and 99 are moved toward the photosensitive drum 2. Therefore, the second developing unit 61 approaches the photosensitive drum 2 due to the moving of the links 97 and 99.

At the same time, the shaft 66 and the pin 78 contact the front ends of the corresponding guide openings 82, and the developing roller 63 of the second developing unit 61 approaches the surface of the photosensitive drum 2. At this time, the links 97 and 99 continuously but slightly move in spite of the shaft 66, and the pin 78 of the second developing unit 61 contacts the front end of the corresponding guide opening 82. Because of this action, the coil springs 105 and 105 are compressed. Therefore, the shaft 66 and the pin 78 of the second developing unit 61 are securely biased against the front ends of the corresponding openings 82 and 82 by the elastic force of the coil springs 105 and 105. As a result, positioning of the second developing unit 61 is accurately performed, and the developing roller 63 of the second developing unit 61 closely faces the surface of the photosensitive drum 2 through a given gap.

A magnet brush B is formed on the surface of the sleeve 65 of the second developing unit 61 with toner Db by the action of the corresponding magnet roller 64. The magnet brush B contacts the surface of the photosensitive drum 2, and an electrostatic latent image formed on the photosensitive drum 2 is developed. At the same time, since the developing roller 63 of the first developing unit 61 is separated from the photosensitive drum 2, developer Da on the developing roller 63 of the first developing unit 61 does not adhere on the photosensitive drum 2. Therefore, only the second developing unit 61 performs the developing operation.

In this state, if an operator selects the action of the first developing unit 60 again, the motor 111 drives the rotary cam 109. By rotation of the rotary cam 109, as shown in FIG. 18, the projecting portion 114 separates from the follower roller 120. By this action, the second developing unit 61 separates from the photosensitive drum 2. Therefore, the first and second developing units 60 and 61 are both separated from the photosensitive drum 2. The position where both the first and second developing units 60 and 61 are separated from the photosensitive drum 2 is maintained momentarily. In this state, the photosensitive drum 2 is rotated a given angle in the clockwise direction. This is done to prevent the mixing of the toner Db adhered on the photosensitive drum 2 and the toner Da contained in the first developing unit 60. That is, when the developing roller 63 of the second developing unit 61 is positioned closely to the photosensitive drum 2, it happens that the toner Db of the second developing unit 61 unfortunately adheres to a portion "a" (shown in FIG. 18) of the photosensitive drum 1 where it faces the developing roller 63 of the second developing unit 61. Therefore, if the second developing unit 61 is separated from the photosensitive drum 2 when the action of the first developing unit 60 is selected, if the first developing unit 60 approaches the photosensitive drum 2, the "a" portion of the photosensitive drum 2 is opposed to the developing roller 63 of the first developing unit 60 by rotation of the photosensitive drum 2. As a result, there is a danger of toner Db from the second developing unit 61 adhered on the "a" portion being mixed in with the toner Da from the first developing unit 60. To prevent this danger, the photosensitive drum 2 is rotated a given angle of more than the angle "$\theta$" (shown in FIG. 18), which is the angle subtending the "a" portion of the photosensitive drum 2. Toner Db unnecessarily adhered on the photosensitive drum 2 is removed by the cleaner 6 during the above-mentioned rotation or subsequent rotation of the photosensitive drum 2.

As above mentioned, the second developing unit 61 is separated from the photosensitive drum 2, and the rotary cam 109 further rotates after the rotary drum 2 rotates by the given angle. Then the projecting portion 114 of the rotary cam 109 moves to contact the follower roller 119 so as to push the follower roller 119. Accordingly, the developing roller 63 of the first developing unit 60 closely faces the photosensitive drum 2, after which the developing action is performed by the magnet brush B formed on the developing roller 63 of the first developing unit 60.

When the selection of the developing units is changed from the action state of the first developing unit 60 to the action state of the second developing unit 61, as the second developing unit 61 is arranged behind the first developing unit 60 in the rotating direction of the photosensitive drum 2, though toner Da of the first developing unit 60 may be unnecessarily adhered on the photosensitive drum 2, there is no danger of the toner Da being mixed with the toner Db of the second developing unit 61. That is, though unnecessary toner Da may be adhered on the photosensitive drum 2, as the toner-adhered portion passes through the cleaner 6 before the toner-adhered portion reaches the second developing unit 61, the cleaner 6 removes the toner Da adhered on the photosensitive drum 2. Therefore, it is not necessary to rotate the photosensitive drum 2 as described above.

Thus, the developing units 60 and 61 are located in suitable action positions by rotation of the rotary cam 109 by appropriate angles. The rotation angle of the rotary cam 109 is detected by the detection switch 118, and, according to this detection, the rotation of the rotary cam 109 is controlled. The follower roller 119 and the follwer roller 120 are both associated with the single rotary cam 109. Thus, the first and second developing units 60 and 61 are moved by only one rotary cam 109. Therefore, there is no waste of operating time, the output power of the motor 111 can be reduced, and high efficiency is obtained.

In the present invention, as described in detail herein, when the developing action is performed with one developing unit, the other developing unit is separated from the image carrier. Therefore, with developing apparatus according to this invention, it is not necessary to rotate the magnet rollers. That is, a drive mechanism to drive the magnet rollers is not necessary. Further, devices according to the present invention are capable of surely preventing the developer from inadvertently adhering to the image carrier.

What is claimed as new and desired to be secured by Letters Patent of the United States is:

1. A copying machine comprising:

(a) an image carrier having a surface on which a latent image can be formed;

(b) a first developing unit arranged close to said image carrier for developing a latent image formed on the surface of said image carrier with a first developer;

(c) a second developing unit arranged close to said image carrier for developing a latent image formed on the surface of said image carrier with a second developer;

(d) a first moving means for moving said first developing unit between a first position in which said first developing unit is operably associated with said image carrier and a second position in which said first developing unit is disassociated from said image carrier, said first moving means comprising a first spring member one end of which is connected to said first developing unit;

(e) a second moving means for moving said second developing unit between a first position in which said second developing unit is operably associated with said image carrier and a second position in which said second developing unit is disassociated from said image carrier, said second moving means comprising a second spring member one end of which is connected to said second developing unit; and (f) an actuating means connected to said first and second means for selectively actuating said first and second moving means so that said first or second developing unit is operably associated with said image carrier while said second or first developing unit is disassociated from said image carrier, said actuating means comprising:

(i) an arm member pivotable about a fulcrum positioned at the middle portion of said arm member, one end of said arm member being connected to the other end of said first spring member while the other end of said arm member is connected to the other end of said second spring member, and (ii) a reversible motor connected to said arm member so as to reversibly pivot said arm member.

2. A copying machine according to claim 1 wherein each of said first and second developing units comprises:

(a) a developing roller which in turn comprises a magnet roller and a sleeve containing said magnet roller therein and (b) a rotary means for rotating said developing roller.

3. A copying machine according to claim 2 and further comprising:

(a) a first rotary driving means for driving said rotary means provided on said first developing unit by coupling with said rotary means when said first developing unit is moved to the position where said first developing unit is operably associated with said image carrier and (b) a second rotary driving means for driving said rotary means provided on said second developing unit by coupling with said rotary means when said second developing unit is moved to the position where said second developing unit is operatively associated with said image carrier.

4. A copying machine according to claim 3 wherein said rotary means and said first and second rotary driving means comprise gears.

5. A copying machine comprising:

(a) an image carrier having a surface on which a latent image can be formed;

(b) a first developing unit arranged close to said image carrier for developing a latent image formed on the surface of said image carrier with a first developer;

(c) a second developing unit arranged close to said image carrier for developing a latent image formed on the surface of said image carrier with a second developer;

(d) a first moving means for moving said first developing unit between a first position in which said first developing unit is operably associated with said image carrier and a second position in which said first developing unit is disassociated from said image carrier, said first moving means including a first follower arm one end of which is connected to said first developing unit;

(e) a second moving means for moving said second developing unit between a first position in which said second developing unit is operably associated with said image carrier and a second position in which said said developing unit is disassociated from said image carrier, said second moving means including a second follower arm one end of which is connected to said second developing unit; and (f) an actuating means connected to said first and second moving means for selectively actuating said first and second moving means so that first or second developing unit is operably associated with said image carrier while said second or first developing unit is disassociated from said image carrier, said actuating means comprising a cam means connected to the other end of said first and second follower arms to move said first and second developing units through said first and second follower arms.

6. A copying machine according to claim 5 wherein:

(a) said cam means comprises a cam plate having a projecting portion and a guide wall formed along the cam surface of said cam plate so as to form a circumferential groove between the cam surface of said cam plate and said guide wall;

(b) each of said first and second follower arms has a follower roller at a free end thereof; and (c) said follower rollers are operatively received in said circumferential groove so as to follow the rotation of said cam plate.

7. A copying machine according to claim 5 wherein:

(a) said first moving means further includes a pair of first links connected to said first developing unit, a pair of first levers one end of each of which is rotatably connected to an associated one of said first links, and a first drive shaft interconnecting said first levers; and (b) said second moving means further includes a pari of second links connected to said second developing unit, a pair of second levers one end of each of which is rotatably connected to an associated one of said second links, and a second drive shaft interconnecting said second levers.

8. A copying machine according to claim 5 wherein each of said first and second developing units comprises:

(a) a developing roller which in turn comprises a magnetic roller and a sleeve containing said magnetic roller therein and (b) a rotary means for rotating said developing roller.

9. A copying machine according to claim 8 and further comprising:

(a) a first rotary driving means for driving said rotary means provided on said first developing unit by coupling with said rotary means when said first developing unit is moved to the position where said first developing unit is operably associated with said image carrier and (b) a second rotary driving means for driving said rotary means provided on said second developing unit by coupling with said rotary means when said second developing unit is moved to the position where said second developing unit is operatively associated with said image carrier.

10. A copying machine according to claim 9 wherein said rotary means and said first and second rotary driving means comprise gears.

* * * * *

US004710016B1

REEXAMINATION CERTIFICATE (3134th)

United States Patent [19] [11] B1 4,710,016

Waatanabe [45] Certificate Issued Feb. 25, 1997

[54] DEVELOPING APPARATUS

[75] Inventor: Junji Waatanabe, Yokohama, Japan

[73] Assignee: Kabushiki Kaisha Toshiba, Kawasaki, Japan

Reexamination Request:
No. 90/004,066, Dec. 8, 1995

Reexamination Certificate for:

| | |
|---|---|
| Patent No.: | **4,710,016** |
| Issued: | **Dec. 1, 1987** |
| Appl. No.: | **835,249** |
| Filed: | **Mar. 3, 1986** |

[30] Foreign Application Priority Data

| | | | |
|---|---|---|---|
| Mar. 26, 1985 | [JP] | Japan | 60-61477 |
| Jul. 15, 1985 | [JP] | Japan | 60-155508 |

[51] Int. Cl.[6] ..... G03G 15/01; G03G 15/08; G03G 15/09

[52] U.S. Cl. ..... 355/326 R

[58] Field of Search ..... 355/245, 251, 355/253, 259, 326 R, 327; 118/653, 657; 430/120, 122

[56] References Cited

U.S. PATENT DOCUMENTS

| | | | |
|---|---|---|---|
| 3,970,042 | 7/1976 | Rees | 118/637 |
| 4,053,216 | 10/1977 | Mailloux | 355/326 X |
| 4,339,196 | 7/1982 | Beck et al. | 355/251 |
| 4,466,379 | 8/1984 | Nishimura | 118/658 |
| 4,591,261 | 5/1986 | Saruwatari et al. | 355/251 |
| 4,615,612 | 10/1986 | Ohno et al. | 355/326 X |
| 4,619,518 | 10/1986 | Kameyama et al. | 355/251 |

*Primary Examiner*—Fred L. Braun
*Attorney, Agent, or Firm*—Richard L. Schwaab; Foley & Lardner

[57] ABSTRACT

A first developing unit is arranged close to an image carrier for developing a latent image formed on the surface of the image carrier with a first developer, and a second developing unit is arranged close to the image carrier for developing a latent image formed on the surface of the image carrier with a second developer. An actuating mechanism is connected to first and second moving mechanism for selectively actuating the first and second moving mechanism so that the first or second developing unit is operatively associated with the image carrier without the rotation of the magnet rollers.

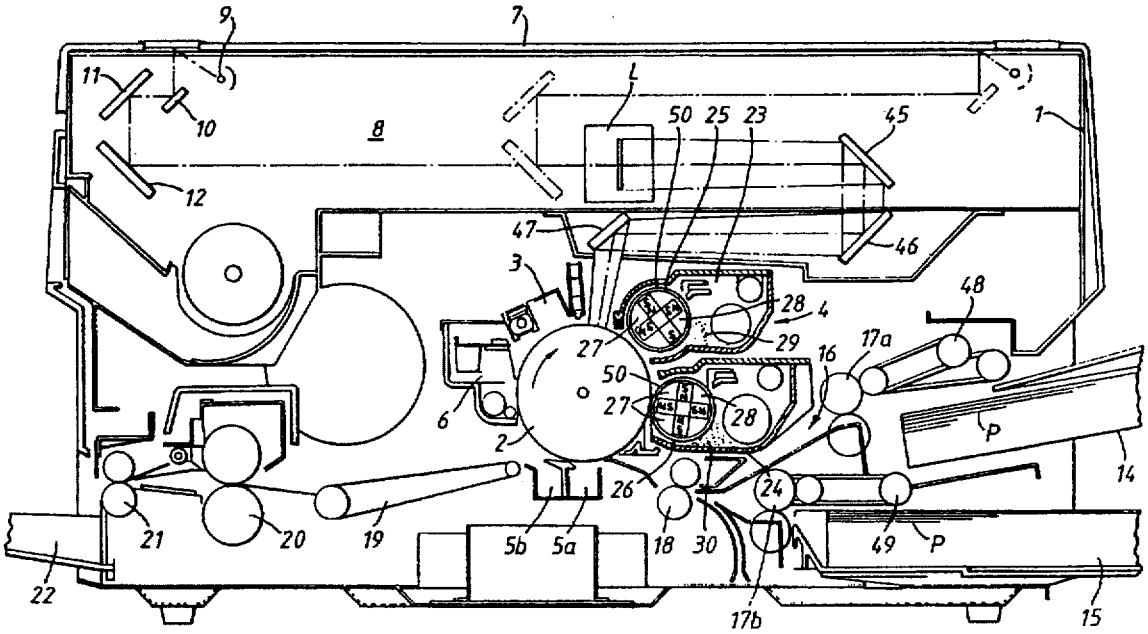

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

Claim 5 is determined to be patentable as amended.

Claims 6–10, dependent on an amended claim, are determined to be patentable.

5. A copying machine comprising:

(a) an image carrier having a surface on which a latent image can be formed;

(b) a first developing unit arranged close to said image carrier for developing a latent image formed on the surface of said image carrier with a first developer;

(c) a second developing unit arranged close to said image carrier for developing a latent image formed on the surface of said image carrier with a second developer;

(d) a first moving means for moving said first developing unit between a first position in which said first developing unit is operably associated with said image carrier and a second position in which said first developing unit is disassociated from said image carrier, said first moving means including a first follower arm one end of which is connected to said first developing unit;

(e) a second moving means for moving said second developing unit between a first position in which said second developing unit is operably associated with said image carrier and a second position in which said [said] developing unit is disassociated from said image carrier, said second moving means including a second follower arm one end of which is connected to said second developing unit; and (f) an actuating means connected to said first and second moving means for selectively actuating said first and second moving means so that first or second developing unit is operably associated with said image carrier while said second or first developing unit is disassociated from said image carrier, said actuating means comprising a cam means connected to the other end of said first and second follower arms to move said first and second developing units through said first and second follower arms.

* * * * *